United States Patent [19]

Hard et al.

[11] Patent Number: 4,470,847

[45] Date of Patent: Sep. 11, 1984

[54] PROCESS FOR MAKING TITANIUM, ZIRCONIUM AND HAFNIUM-BASED METAL PARTICLES FOR POWDER METALLURGY

[75] Inventors: Robert A. Hard, Laguna; Joseph A. Megy, Mission Viejo, both of Calif.

[73] Assignee: Occidental Research Corporation, Los Angeles, Calif.

[21] Appl. No.: 439,801

[22] Filed: Nov. 8, 1982

[51] Int. Cl.[3] ..... B22F 1/00

[52] U.S. Cl. ..... 75/84.4; 75/0.5 BB; 419/33; 419/30

[58] Field of Search ..... 75/84.4, 0.5 BB; 419/33, 30

[56] References Cited

U.S. PATENT DOCUMENTS

| | | | |
|---|---|---|---|
| 2,418,074 | 3/1947 | Kawecki | 23/18 |
| 2,475,287 | 7/1949 | Kawecki | 23/88 |
| 2,568,341 | 9/1951 | Kawecki et al. | 23/88 |
| 2,653,855 | 9/1953 | Kawecki | 22/19 |
| 2,812,237 | 11/1957 | Wainer | 23/88 |
| 2,837,426 | 6/1958 | Kamlet | 75/175.5 |
| 3,015,556 | 1/1962 | Korpi et al. | 75/84 |
| 3,607,012 | 9/1971 | Schossberger et al. | 23/87 |
| 3,746,535 | 7/1973 | Brandstatter | 75/84.5 |
| 3,903,239 | 9/1975 | Berkovich | 423/82 |
| 3,950,166 | 4/1976 | Obara et al. | 419/33 |
| 4,058,393 | 11/1977 | McLaughlin | 75/1 T |
| 4,098,868 | 7/1978 | Tolley | 423/83 |
| 4,107,264 | 4/1978 | Nagasubramanian et al. | 423/81 |
| 4,119,696 | 10/1978 | Tolley | 423/82 |
| 4,119,697 | 10/1978 | Tolley | 423/82 |
| 4,127,409 | 11/1978 | Megy | 75/84.4 |
| 4,141,719 | 2/1979 | Hakko | 419/33 |
| 4,168,297 | 9/1979 | Nagasubramanian et al. | 423/70 |
| 4,175,110 | 11/1979 | Tolley | 423/83 |
| 4,175,952 | 11/1979 | Tolley | 75/101 R |
| 4,178,176 | 12/1979 | Tolley | 423/82 |
| 4,197,276 | 4/1980 | Tolley et al. | 423/82 |
| 4,199,552 | 4/1980 | Rado | 423/83 |
| 4,202,863 | 5/1980 | Tolley | 423/82 |
| 4,369,078 | 1/1983 | Aslund | 419/33 |
| 4,390,365 | 6/1983 | Hard et al. | 75/84.4 |

OTHER PUBLICATIONS

Thomas et al., "*The Metallurgy of Hafnium*", *USAEC, 1960, pp. 84 and 85.*

Miller, *Zirconium*, Butterworths Scientific Publications; London, 1957, p. 129.

*Primary Examiner*—Brooks H. Hunt

*Attorney, Agent, or Firm*—Christie, Parker & Hale

[57] ABSTRACT

A process to produce passified Group IVb transition metal based metal particles having a controlled particle size distribution is disclosed which produces particles suitable for metallurgy usage without additional particle size reduction. Such particles are also substantially free of halides and are produced at temperatures considerably below that of arc melting temperatures of Group IVb transition metals and alloys based thereon.

28 Claims, 2 Drawing Figures

PROCESS FOR MAKING TITANIUM, ZIRCONIUM AND HAFNIUM-BASED METAL PARTICLES FOR POWDER METALLURGY

CROSS-REFERENCE TO RELATED PATENT APPLICATIONS

This patent application is related to U.S. Ser. No. 216,058 filed Dec. 22, 1980, and titled "Process for Making Titanium Metal from Titanium Ore".

BACKGROUND OF THE INVENTION

Group IVb transition metals, specifically titanium, zirconium and hafnium, are essential to the aerospace, nuclear, and the chemical processing industries. The high strength and excellent resistance to chemical attack of metals having titanium, zirconium and hafnium as a base are the principal reasons for their demand. Demand for Group IVb metals has outstripped production capabilities in some countries.

Titanium is a strong, light metal that is useful at many temperatures, malleable when heated and ductile when pure. It is used in the pure state or in alloys for aircraft and chemical industry, for surgical instruments, and in cermets, and metal-ceramic braising. Zirconium is a hard metal that is strong and ductile and is used in the nuclear industry and in alloys, pyrotechnics, welding fluxes and explosives. Hafnium, although not as widely used because of its relative expense, is used primarily in the nuclear and chemical process industries. For many uses, alloys which are based on the Group IVb metals have better properties and wider usage than the pure metals themselves.

Impurities outside specification values in the Group Ivb metals and alloys based on the Group IVb metals can cause such metals and alloys based thereon to be brittle and hence, of little use. Impurities such as halides, carbon, oxygen, nitrogen and silicon can cause the Group IVb metals and alloys based thereon to be greatly reduced in strength and chemical resistance.

The Group IVb metals and alloys based thereon are also useful in powder metallurgy for the production of articles which would be more expensive or more difficult to produce by machining or forging from massive metal shapes. This invention is directed toward the production of Group IVb metal powders and alloy powders based on Group IVb metals. Articles made from such powders can be ground, milled, drilled and welded.

SUMMARY OF THE INVENTION

This invention relates to a process for the preparation of passified Group IVb transition metal-based particles, and alloys based thereon which are substantially free of halides, and which are suitable for powder metallurgy usage without further particle size reduction. By particles as used herein, is meant to include powders and granules as well as particles.

A very important advantage of this invention is the capability of producing metal shapes, i.e., near net shapes, directly from a metal sponge without the necessity of an expensive arc melting step which is required in conventional technology for consolidation or alloying of the Group IVb transition metal.

In one embodiment of this invention, which comprises hydriding, such passified Group IVb transition metal-based metal particles are produced by heating a Group IVb transition metal-zinc alloy which is substantially free of halides, at a temperature between about 500 and about 1150° C. under conditions which are operative to vaporize and separate the zinc from such alloy and to produce a Group IVb transition metal or metal based thereon which is substantially free of both zinc and halides. By substantially free of zinc herein is meant less than 0.1% by weight. By substantially free of halides herein is meant less than 0.02%. In some embodiments of this invention, no more than about 100 parts per million by weight (PPM) of zinc and about 50 PPM of halides are contained in the Group IVb transition metal-zinc alloy. By Group IVb transition metal-zinc alloy herein is meant a titanium-zinc alloy or zirconium-zinc or hafnium-zinc alloy. The thusly, produced transition metal or metal based thereon is heated to, or maintained at, a temperature between about 850° and about 1150° C. under conditions which are operative to sinter the transition metal. Sintering is necessary in order to reduce the amount of oxygen or nitrogen required for subsequent passification of the transition metal, or alloy based thereon, so that it may be readily and safely stored and used for powder metallurgy at a later time.

During sintering, the particles shrink in size by about 50 to about 85% but in general retain their original shape. Such sintered particles are not fused together although usually there is some sticking or adhering of the particles to each other. Such adhered particles can be readily separated by mechanical means.

The particles of sintered transition metal values are cooled to a lower temperature between about 300° and 700° C. during which time they are simultaneously contacted with hydrogen or gaseous stream containing hydrogen under conditions which are operative to hydride and embrittle the sintered transition metal values. By transition metal values herein is meant either a Group IVb transition metal or a Group IVb transition metal-based metal. The hydrided and embrittled transition metal values can now be readily comminuted to a predetermined particle size distribution. The hydriding and subsequent embrittlement greatly facilitates controlling the comminution of the Group IVb transition metal values. The improved controllability afforded by the hydriding of the Group IVb transition metal values is a particularly important aspect of this invention because it ultimately enables the production of a passified Group IVb transition metal-based metal particles of a size distribution readily adaptable and operable for powder metallurgy usage.

Such hydrided and embrittled transition metal-based metal particles are now comminuted under a non-deleteriously-reactive atmosphere, to a predetermined particle size distribution. The comminuted transition metal values are treated at a temperature between about 400° and about 700° C. under conditions operative to remove essentially all hydrogen values from the comminuted transition metal values and to produce Group IVb transition metal-based metal particles. By the expression "removing essentially all hydrogen values from the comminuted transition metal values" is meant that the transition metal values contain no more than about 200 PPM of hydrogen.

The dehydrided Group IVb transition metal-based metal particles are then contacted with a small amount of a gas selected from the group consisting of oxygen, nitrogen and mixtures thereof, under conditions operative to passify the transition metal particles thereby producing passified transition metal particles. The controlled comminuting of the hydrided and embrittled transition metal values is such that the passified transition metal-based metal particles ultimately produced have at least a substantial amount by weight of such transition metal-based metal particles which are suitable for powder metallurgy usage without further particle size reduction. As used herein, a substantial amount is meant at least about 50% by weight of the passified transition metal-based metal particles produced. In one embodiment of this invention, at least about 95% by weight of the particles produced are suitable for powder metallurgy use without further particle size reduction. Generally, particles no greater than about ¼ inch are suitable for powder metallurgy usage without further particle size reduction. It is to be noted that this embodiment of this invention is particularly useful where extremely fine powder metallurgical particles are required or where a large yield of suitable powder is required, or where a highly tailored particle size distribution is required which is not easily or economically obtainable by other means.

In one further embodiment of this invention, the heating of the Group IVb transition metal-zinc alloy to vaporize zinc therefrom, and the subsequent sintering of the transition metal values produced thereby is conducted in the same zone or vessel. In other embodiment, the hydriding and embrittlement of the sintered transition metal values are also conducted in the same zone or vessel as the zinc vaporization and sintering steps.

In another further embodiment of this invention, the nondeleteriously-reactive atmosphere used during the comminuting of the embrittled transition where values is an inert gas. In another embodiment, the nondeleteriously-reactive atmosphere is hydrogen.

In still another further embodiment of this invention, the heating or distillation of the Group IVb transition metal-zinc alloy to vaporize and separate zinc therefrom, is conducted under a partial vacuum. In a second embodiment of this invention, such heating is conducted under a continuous flow of a nondeleteriously-reactive sweep gas. In a further embodiment, the sweep gas is selected from the Group consisting of hydrogen, and inert gas, and mixtures thereof.

In one further embodiment of this invention, the dehydriding of the particles of transition metal values is conducted under a partial vacuum.

Another embodiment of this invention, which does not necessarily require hydriding to produce particles suitable for powder metallurgy usage, produces passified Group IVb transition metal-based metal particles which are substantially free of halides, and which are suitable for powder metallurgy usage, from a Group IVb transition metal-zinc alloy by a process which comprises forming a Group IVb transition metal-zinc alloy which is substantially free of halides, into particles having a particle size distribution of about 90% by weight between about 80 mesh and about ¼ inch. Then, heating such particles in a zone maintained at a temperature between about 500° and 1150° C., and simultaneously introducing into the zone a continuous flow of a nondeleteriously-reactive sweep gas. The zone is maintained under conditions operative to vaporize and separate zinc from the transition metal-zinc alloy particles and thereby produce particles of Group IVb transition metal values which are substantially free of zinc and halides. Such transition metal values will comprise essentially the pure Group IVb transition metal or such metal with minor amounts of other metals desirable in the ultimate final product. For example, such other metals which may be desirable in the final product and known to those skilled in the art, include but are not limited to aluminum and vanadium. For example, a titanium based metal may contain about six percent aluminum and/or about four percent vanadium.

The thusly formed particles which are substantially free of zinc and halides are then heated to, or maintained at, a sintering temperature between about 850° and 1150° C. under conditions operative to sinter such particles. In general, sintering results in a reduction of the surface area of such particles and because of the reduction in surface area, subsequent passification with a passifying gas will require substantially less amount of such gas.

The sintered particles are then cooled to a temperature between about ambient and about 200° C. and then contacted with a small amount of a gas selected from the Group consisting of oxygen, nitrogen, and mixtures thereof, under conditions operative to passify the cooled, sintered particles, thereby producing Group IVb passified transition metal-based metal particles which are substantially free of halides. In all embodiments of this invention, it is essential that the Group IVb passified transition metal-based metal particles be substantially free of halides since halide contamination of the final product can cause voids, loss of strength and fracture toughness, and welding problems.

An important feature of this embodiment of this invention is the forming of a transition metal-zinc alloy of a specified and particular particle size distribution such that the Group IVb transition metal-zinc alloy particles will have a particle size distribution of about 90% by weight between about 80 mesh and about ¼ inch, and the subsequent sintering of such particles at a sintering temperature between about 850° and 1150° C., in combination with the other steps of this process, are operative to cause the passified transition metal-based metal particles ultimately produced to have a particle size distribution such that a significant amount by weight of said passified Group IVb metal-based metal particles are suitable for powder metallurgy usage without additional particle size reduction. By significant amount by weight suitable for powder metallurgy usage without additional particle size reduction as used herein is meant at least about 5% by weight. This embodiment of this invention is, however, capable of producing particles wherein at least about 80% by weight are suitable for powder metallurgy usage without additional particle size reduction.

An advantage of the invention is that the shape or configuration of the feed Group IVb transition metal-zinc alloy particles prior to vaporization of the zinc therefrom, and the subsequent sintering of the particles of Group IVb transition metal values, produces particles having about 15 to about 50% of the volume of the feed alloy particles. Thus, it is possible to predetermine the shape of the feed alloy particles and produce psuedomorph particles of the feed alloy particles.

In a further embodiment, the heating or distillation of the particles of transition metal-zinc alloy at a temperature between about 500° and about 1150° C., and the subsequent sintering of the zinc free particles therefrom, are conducted in the same zone or vessel. In a still further embodiment, the cooling and passification of the sintered particles are also conducted in the same zone or vessel as the zinc vaporization and sintering steps.

In still another further embodiment of this invention, the heating or distillation of the Group IVb transition metal-zinc alloy to vaporize and separate zinc therefrom, is conducted under a partial vacuum. In a second embodiment of this invention, the nondeleteriously-reactive sweep gas used in the heating or distillation of the Group IVb transition metal-zinc alloy is an inert gas. In an alternate embodiment such nondeleteriously-reactive sweep gas is hydrogen. However, where hydrogen is used as the sweep gas, it is necessary to remove all hydrogen values from the final Group IVb transition metal-base particles since hydrogen will cause embrittlement of such particles.

In a further embodiment of this process, the Group IVb transition metal-zinc alloy particles have a particle size distribution of about 90% by weight between about 60 mesh and about 20 mesh before such particles are heated or distilled at a temperature between about 500° and about 1150° C. to vaporize the zinc therefrom.

In another embodiment of this invention, the forming of a Group IVb transition metal-zinc alloy into such particles is by comminuting of the alloy. In an alternate embodiment such particles are formed by casting.

The following additional embodiments of this invention are useful whether or not hydriding is employed to facilitate comminution of the transition metal values.

In one embodiment of this process, the Group IVb transition metal-zinc alloy is produced by a process comprising fluorinating a Group IVb transition metal-bearing ore, which comprises Group IVb transition metal oxides, by contacting with an alkali metal fluosilicate at a temperature of from about 600° to about 1000° C. to form a fluorinated ore and to convert the Group IVb transition metal oxides to Group IVb transmission metal fluorides; and reducing such fluorides with a zinc alloy to produce the Group IVb transition metal-zinc alloy.

In a second embodiment of this invention, the Group IVb transition metal-zinc alloy is produced from Group IVb transition metal sponge and zinc. In a third embodiment of this invention, the Group IVb transition metal-zinc alloy is produced from the reduction of a transition metal halide with a metal alloy which comprises a reductant metal and zinc. Aluminum is the preferred reductant metal. In a preferred embodiment of this invention, a titanium-zinc alloy is used.

In one embodiment of this invention, the entire process is conducted at temperatures which are no higher than about 1300° C., and in a preferred embodiment, the entire process is conducted at temperatures which are no higher than about 1150° C. Thus, temperatures reached during high temperature arc melting processes, required for consolidation of, and/or alloying of, for example, titanium products produced by the "Kroll Process", are not required. In other words, the high temperatures required for arc melting are simply not required for this process. Arc melting processes generally require temperatures which exceed the melting point of the particular Group IVb transition metal by about 50° to about 100° C. Such high temperature processes, including those requiring arc melting, require costly equipment which is simply not required by this invention. Thus, a distinct advantage of this invention is the avoidance of very high temperatures required in processes which comprise arc melting.

Some of the advantages of using hydrogen as the sweep gas in the heating or distillation to vaporize zinc from the Group IVb transition metal-zinc alloy are hydrogen because of its low molecular weight facilitates the diffusion of zinc out of the Group IVb transition metal sponge pores and by virtue of such improved diffusion improved heat transfer is also realized. In addition, hydrogen is cheaper than helium and argon and other inert gases. Furthermore, although the hydrogen tie bond is weak, nevertheless even a weak hydrogen tie bond will help displace zinc as opposed to inert gases where there is no tie bond between the inert gas and the Group IVb transition metal at all. However, if hydrogen is used, substantially all hydrogen values must be removed from the final metal particle product. By substantially all hydrogen values being removed from the final metal particle product it is meant that no more than about 200 PPM of hydrogen is permitted in the final metal particles produced, and preferably no more than about 50 PPM of hydrogen is in the final product. This is to be compared with conventional process which produce particles having 200 PPM of hydrogen. However, it should be noted that in some embodiments of this invention the process is capable of producing product particles having an even lower PPM of hydrogen than 50 PPM.

It is also desirable and the process is capable of producing such Group IVb transition metal-based metal particles which are substantially free as used herein is meant no more than about 2500 PPM of oxygen, 400 PPM of nitrogen, and 800 PPM of carbon. In some embodiment of this invention, no more than about 8000 PPM of oxygen, 90 PPM of nitrogen, and/or 150 PPM of carbon are contained in the product particles of Group IVb transition metal values.

Another advantage of this invention is that the Group IVb transition metal-zinc alloy can contain any desirable additional alloying agents such as aluminum, vanadium or other beneficial elements, which are desirable in the final product particles. Such alloying agents are not required to be added in a high temperature arc melting step. In fact, arc melting is not required in this invention. Such alloying agents remain with the Group IVb transition metal as the zinc is vaporized and separated therefrom.

In a preferred embodiment of this invention, the heating or distillation of zinc from the alloy is conducted at a temperature between about 900° and about 950° C., sintering is conducted between about 1020° and about 1060° C., embrittlement and hydriding is conducted between about 600° and about 700° C., and passification is conducted at about ambient to about 60° C.

It will be appreciated that a particular advantage of this process is the avoidance of entrapment of halide salts in the passified transition metal-based metal particle product. Another advantage is that heating or distillation to vaporize and separate zinc and sintering may be conducted in the same zone, reactor, or vessel.

DESCRIPTION OF THE PREFERRED EMBODIMENT

Figure 1:
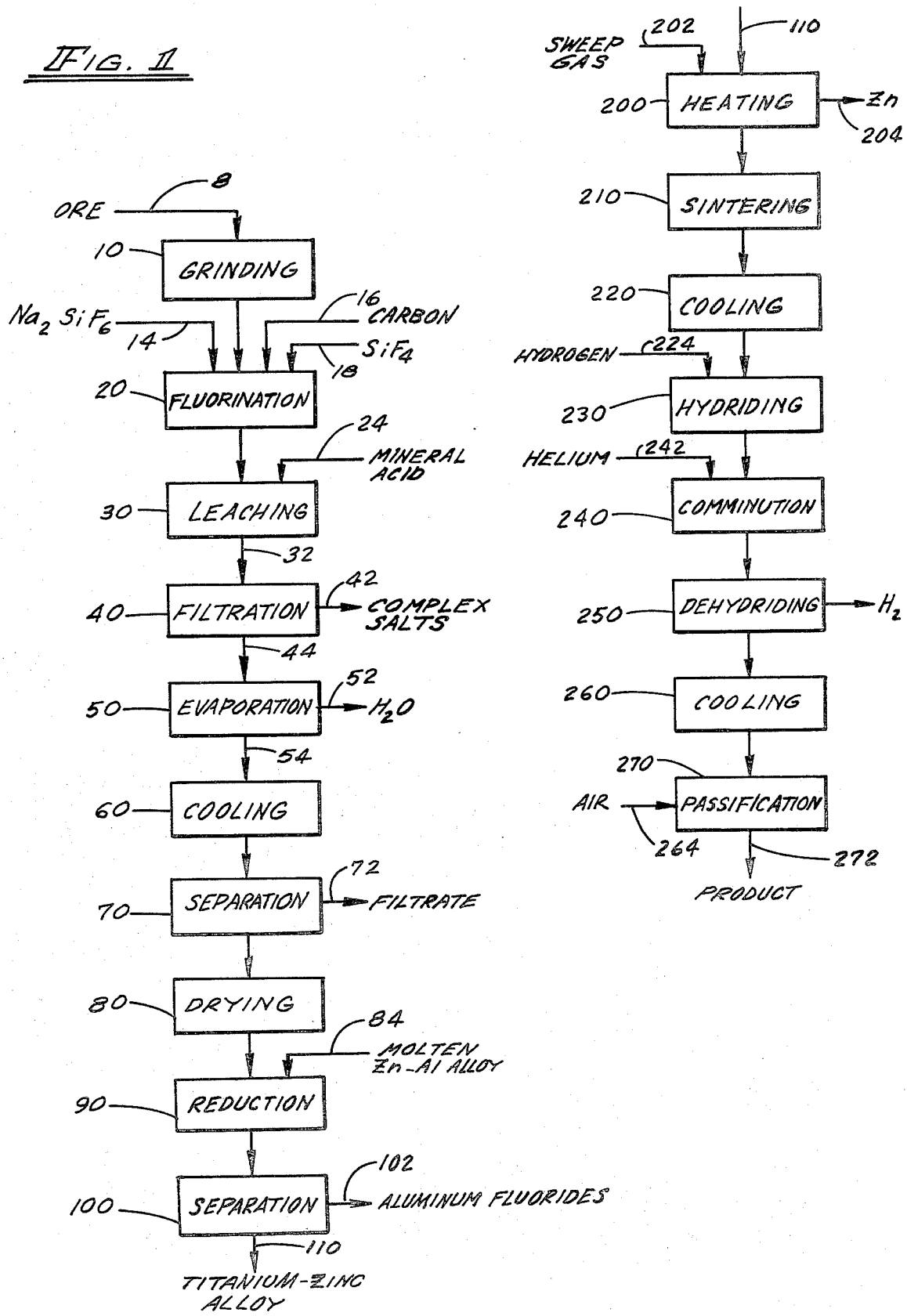
FIG. 1 is a flow sheet of one embodiment of this invention which comprises hydriding and dehydriding steps.

Referring to FIG. 1, ilmenite 8, an ore comprising titanium and iron oxides, is ground to a finely divided physical state in zone 10 to make it more susceptible to fluorination, such as between 30 and 400 mesh. The ore is fluorinated in zone 20 with a fluosilicate such as sodium fluosilicate introduced in stream 14. The mixture of sodium fluosilicate and ore is heated to a temperature of at least about 600° C. preferably from 750° to 950° C. for a time sufficient to change the iron and titanium from oxide form to fluoride form. The addition of carbon by stream 16 to the mixture has been found to have a synergistic effect on the fluorination of the ore. The reaction is carried out under an atmosphere of a gaseous fluorinating agent such as silicon tetrafluoride which can be generated in situ, or which can be introduced by stream 18. Preferably, the fluorination reaction may be carried out under a partial pressure of from about 0.1 to about 500 psig of silicon tetrafluoride. The thusly fluorinated ore is then leached in zone 30 with an aqueous solution of a strong acid such as hydrochloric or sulfuric acid introduced in stream 24. The leaching is conducted under conditions to solubilize as much of the fluorides of titanium as economically possible. Leaching may be enhanced with addition of aqueous hydrogen fluoride solution.

The mixture is then filtered in zone 40 to remove oxidized iron as complex salts of ferric hydroxide-fluoride in stream 42. The filtrate in stream 44 comprises soluable fluorides of titanium and as for example sodium fluotitanate. The solution may be evaporated in zone 50 to concentrate soluable fluorides and the concentrated solution cooled in zone 60 to crysalize fluorides of titanium. The crystals of fluorides of titanium are separated in zone 70, dried in zone 80, and reduced in a molten state in zone 90 with a molten zinc-aluminum alloy introduced in stream 84. In one embodiment, zones 50, 60 and 70 can be all in one zone or vessel. The molten titanium fluoride salts and the zinc-aluminum alloy are essentially immiscible. Reduction is conducted at a temperature of at least about 650° C. up to about 1000° C. with agitation. After reduction is completed, agitation is ceased, and the mixture is separated in separation zone 100, into an upper phase comprising an aluminum fluoride salt which is removed in stream 102, and a lower phase comprising a titanium-zinc alloy which is removed in stream 110. The titanium-zinc alloy is substantially free of halides.

It will be understood that although a titanium-zinc alloy has been produced by the process described above, a zirconium-zinc alloy or a hafnium-zinc alloy can be produced by a similar sequence of processing steps using zirconium or hafnium ores or values.

It is desirable to have as much titanium reduced into the molten zinc alloy in zone 90 as possible to minimize the amount of zinc to be separated in the next step. The amount of titanium in the zinc can be substantially increased by operating zone 90 under a positive pressure. The titanium-zinc alloy removed in stream 110, which is substantially free of halides, is heated or distilled in zone 200 at a temperature between about 900° and 1000° C. while simultaneously introducing into zone 200 a continuous flow of a hydrogen sweep gas in stream 202 under conditions effective for vaporizing and separating zinc from the alloy and to produce titanium values which are substantially free of zinc and halides. Such titanium values are then heated in the same vessel, dipicted as zone 210, to a temperature between about 1020° and about 1060° C. under conditions operative to sinter such titanium values.

The sintered titanium values are cooled to a temperature between about 600° and about 700° C. in zone 220 and simultaneously treated, as depicted in zone 230, with hydrogen introduced in stream 224 under conditions operative to hydride and embrittle the sintered titanium values. The hydrided and embrittled titanium values are then crushed in zone 240 under an inert atmosphere, preferrably helium introduced through stream 242, to form particles of titanium metal values. The particles of titanium metal values are dehydrided in zone 250 at a temperature between about 600° and about 700° C. under conditions operative to remove essentially all hydrogen values from the particles of titanium values. The dehydrided particles are cooled in zone 260 to a temperature between ambient and about 60° C. and then passified in zone 270 with a relatively small amount of air introduced in stream 264. At least a substantial part of the passified titanium-based metal particles thusly produced and removed in stream 272 are suitable for powder metallurgy usage without further particle size reduction.

Figure 2:
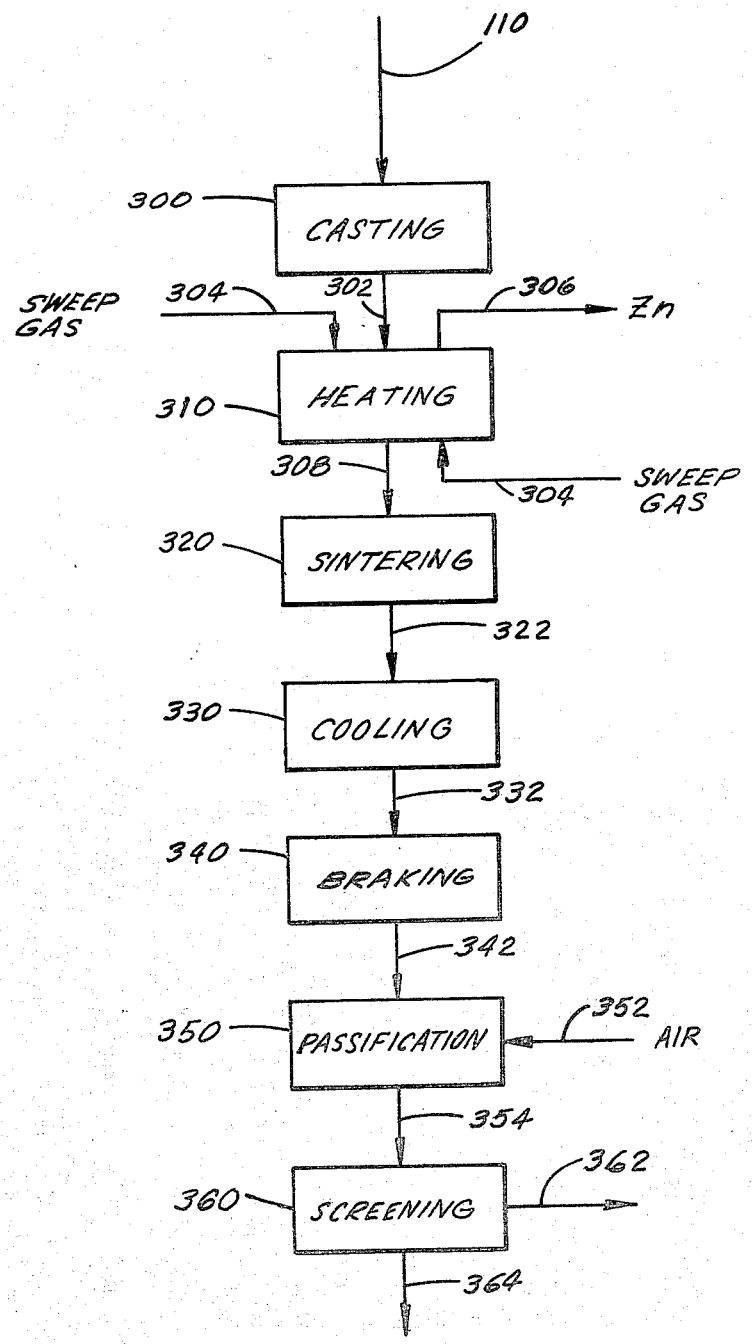
FIG. 2 is an alternate embodiment of this invention which does not require hydriding and dehydriding steps.

Referring to FIG. 2, in an alternate process, a molten stream of a titanium-zinc alloy 130, which can be prealloyed with other desirable alloying agents such as aluminum and vanadium, is introduced into casting zone 300 wherein it is formed into particles having a particle size distribution between about 60 mesh and about 20 mesh. The 60 to 20 mesh particles are removed in stream 302 and introduced into heating or distillation zone 310 along with a continuous flow of helium sweep gas introduced through stream 304. In heating zone 310, which is operated at atmosphere pressure, the zinc is vaporized from the titanium-zinc matrix and removed through stream 306. Particles of titanium values, which are substantially free of zinc and halides, are removed by stream 308 and introduced into sintering zone 320 which is maintained at a sintering temperature between about 1020° and 1060° C. to sinter the particles of titanium values. During sintering the particles of titanium values shrink but do not fuse through some weak sticking or adhering of particle-to-particle usually occurs. The sintered particle masses are removed through stream 322 annd introduced into cooling zone 330 whereby they are cooled to a temperature between about ambient and about 60° C. The cooled particles are removed through stream 332 and introduced into breaking zone 340 wherein the weakly adhered particle masses are broken apart by suitable mechanical means under nondeleteriously-reactive environment. The thusly separated particles are removed in stream 342 are introduced into passification zone 350 where they are passified with a relatively small amount of air introduced through stream 352. In an alternate embodiment breaking of the weakly adhered particle masses can be performed after passification. In some embodiments such breaking is not required. Passified titanium-based metal particles are removed through stream 354 and introduced into screening zone 360 wherein oversized particles are separated and removed through stream 362 and particles having a desirable particle size are removed through stream 364. A substantial amount by weight of passified particles of titanium values having a desired particle size suitable for powder metallurgy usage without additional particle size reduction are removed through stream 364.

It is to be understood that the foregoing detailed discription is given merely as an illustrative example and that various modifications, changes, variations, and equivalent steps may be made to the invention herein described without departing from the spirit and scope of the present invention. For example, steps conducted at atmospheric pressure may in some circumstances be beneficially conducted at slightly higher or lower pressure than atmospheric and hence, by atmospheric we mean to include such slight pressure variations. Other elements are to be construded similarly.

What is claimed is:

1. A process to produce passified Group IVb transition metal-based metal particles which are substantially free of halides, and which are suitable for powder metallurgy usage, from a Group IVb transition metal-zinc alloy comprising:

(a) heating a Group IVb transition metal-zinc alloy, which is substantially free of halides, at a temperature between about 500° and about 1150° C. under conditions operative to vaporize and separate zinc therefrom and to produce Group IVb transition metal values which are substantially free of zinc and halides;

(b) heating said transition metal values to, or maintaining said transition metal values at, a sintering temperature between about 850° and about 1150° C. under conditions operative to sinter said transition metal values;

(c) cooling said sintered transition metal values to a lower temperature between aboout 300° and about 700° C., and simultaneously contacting said sintered transition metal values with hydrogen under conditions operative to hydride and embrittle said sintered transition metal values, thereby forming embrittled transition metal values;

(d) comminuting said embrittled transition metal values under a nondeleteriously-reactive atmosphere, to a predetermined particle size distribution thereby forming particles of transition metal values;

(e) dehydriding said particles of transition metal values at a temperature between about 400° and about 700° C. under conditions operative to remove essentially all hydrogen values from said particles of transition metal values and to produce dehydrided particles of transition metal values; and (f) contacting said dehydrided particles with a small amount of a gas selected from the group consisting of oxygen, nitrogen, and mixtures thereof under conditions operative to passify said dehydrated particles thereby producing passified Group IVb transition metal based metal particles which are substantially free of halides; and (g) said comminuting of said embrittled transition metal values to predetermined particle size distribution in step (d) being operative to cause said passified transition metal based metal particles produced in step (f) to have a particle size distribution such that at least a substantial amount by weight of said passified transition metal-based metal particles are suitable for powder metallurgy usage without further particle size reduction.

2. The process of claim 1 wherein steps (a) and (b) are conducted in the same vessel.

3. The process of claim 1 wherein steps (a), (b) and (c) are conducted in the same vessel.

4. The process of claim 1 wherein said nondeleteriously-reactive atmosphere used in step (d) is an inert gas.

5. The process of claim 1 wherein said Group IVb transition metal-zinc alloy is produced from a process comprising fluorinating a Group IVb transition metal-bearing ore, which comprises Group IVb transition metal oxides, by contacting with an alkali metal fluosilicate at a temperature of from about 600° to about 1000° C. to form a fluorinated ore and to convert said Group IVb transition metal oxides to Group IVb transition metal fluorides; and reducing said Group IVb transition metal fluorides with a zinc alloy to produce said Group IVb transition metal-zinc alloy.

6. The process of claim 4 wherein said Group IVb transition metal-zinc alloy is produced from Group IVb transition metal sponge and zinc.

7. The process of claim 1 wherein said Group IVb transition metal-zinc alloy is produced from the reduction of a transition metal halide with a metal alloy which comprises a reductant metal and zinc.

8. The process of claim 1 wherein said Group IVb transition metal-zinc alloy is a titanium-zinc alloy.

9. The process of claim 1 wherein said heating in step (a) is conducted under a partial vacuum.

10. The process of claim 1 wherein said heating in step (a) is conducted under a continuous flow of a nondeleteriously-reactive sweep gas.

11. The process of claim 10 wherein said nondeleteriously-reactive sweep gas is selected from the group consisting of hydrogen, an inert gas, and mixtures thereof.

12. The process of claim 1 wherein said dehydriding in step (e) is conducted under a partial vacuum.

13. The process of claim 5 wherein the entire process is conducted at temperatures which are no higher than about 1300° C.

14. A process to produce passified Group IVb transition metal-based, metal particles which are substantially free of halides, and which are suitable for powder metallurgy usage, from a Group IVb transition metal-bearing ore comprising:

(a) fluorinating a Group IVb transition metal-bearing ore, which comprises Group IVb transition metal oxides, by contacting said ore with an alkali metal fluosilicate at a temperature of from about 600° to about 1000° C. to form a fluorinated ore and to convert said Group IVb transition metal oxides to Group IVb transition metal fluorides;

(b) reducing said Group IVb transition metal fluorides with a zinc alloy to produce a Group IVb transition metal-zinc alloy;

(c) heating said Group IVb transition metal-zinc alloy, which is substantially free of halides, at a temperature between about 500° and about 1150° C. under conditions operative to vaporize and separate zinc therefrom and to produce Group IVb transition metal values which are substantially free of zinc and halides;

(d) heating said transition metal values to, or maintaining said transition metal values at, a sintering temperature between about 850° and about 1150° C. under conditions operative to sinter said transition metal values;

(e) cooling said sintered transition metal values to a lower temperature between about 300° and about 700° C., and simultaneously contacting said sintered transition metal values with hydrogen under conditions operative to hydride and embrittle said sintered transition metal values, thereby forming embrittled transition metal values;

(f) comminuting said embrittled transition metal values under a nondeleteriously-reactive atmosphere, to a predetermined particle size distribution thereby forming particles of transition metal values;

(g) dehydriding said particles of transition metal values at a temperature between about 400° and about 700° C. under conditions operative to remove essentially all hydrogen values from said particles of transition metal values and to produce dehydrided particles of transition metal values;

(h) contacting said dehydrided particles with a small amount of a gas selected from the group consisting of oxygen, nitrogen, and mixtures thereof under conditions operative to passify said dehydrided particles thereby producing passified Group IVb transition metal-based, metal particles which are substantially free of halides; and (i) said comminuting of said embrittled transition metal values to predetermined particle size distribution in step (f) being operative to cause said passified transition metal-based, metal particles produced in step (h) to have a particle size distribution such that at least a substantial amount by weight of said passified transition metal-based, metal particles are suitable for powder metallurgy usage without further particle size reduction, and wherein the entire process is conducted at temperatures which are no higher than about 1150° C.

15. A process to produce passified Group IVb transition metal based metal particles which are substantially free of halides, and which are suitable for power metallurgy usage, from a Group IVb transition metal-zinc alloy comprising:

(a) forming a Group IVb transition metal-zinc alloy, which is substantially free of halides, into particles having a particle size distribution of about 90% by weight between about 80 mesh and about ¼ inch;

(b) heating said particles in a zone maintained at a temperature between about 500° and about 1150° C., and simultaneously introducing into said zone a continuous flow of a nondeleteriously-reactive sweep gas, said zone being maintained under conditions operative to vaporize and separate zinc from said transition metal-zinc alloy particles and to produce first particles of Group IVb transition metal values which are substantially free of zinc and halides;

(c) heating said first particles to, or maintaining said first particles at, a sintering temperature between about 850° and 1150° C. under conditions operative to sinter said first particles;

(d) cooling said sintered first particles to a lower temperature between about ambient temperature and about 200° C.;

(e) contacting said cooled sintered first particles with a small amount of a gas selected from the group consisting of oxygen, nitrogen, and mixtures thereof under conditions operative to passify said cooled sintered first particles, thereby producing Group IVb passified transition metal-based metal particles which are substantially free of halides; and (f) said forming a transition metal-zinc alloy of a specified particle size distribution in step (a), and said heating of said first particles in step (c) being operative to cause said passified transition metal-based metal particles produced in step (e) to have a particle size distribution such that a significant amount by weight of said passified transition metal-based metal particles are suitable for powder metallurgy usage without additional particle size reduction.

16. The process of claim 15 wherein steps (b) and (c) are conducted in the same vessel.

17. The process of claim 15 wherein steps (b), (c), (d) and (e) are conducted in the same vessel.

18. The process of claim 15 wherein said Group IVb transition metal-zinc alloy is produced from a process comprising fluorinating a Group IVb transition metal-bearing ore, which comprises Group IVb transition metal oxides, by contacting with an alkali metal fluosilicate at a temperature of from about 600° to about 1000° C. to form a fluorinated ore and to convert said Group IVb transition metal oxides to Group IVb transition metal fluorides; and reducing said Group IVb transition metal fluorides with a zinc alloy to produce said Group IVb transition metal-zinc alloy.

19. The process of claim 15 wherein said Group IVb transition metal-zinc alloy is produced from Group IVb transition metal sponge and zinc.

20. The process of claim 15 wherein said Group IVb transition metal-zinc alloy is produced from the reduction of a Group IVb transition metal halide with a metal alloy which comprises a reductant metal and zinc.

21. The process of claim 15 wherein said Group IVb transition metal-zinc alloy is a titanium-zinc alloy.

22. The process of claim 15 wherein said nondeleteriously-reactive sweep gas used in step (b) is an inert gas.

23. The process of clam 15 wherein said heating in step (b) is conducted under a partial vacuum.

24. A process to produce passified Group IVb transition metal-based, metal particles which are substantially free of halides, and which are suitable for powder metallurgy usage, from a Group IVb transition metal-bearing ore comprising:

(a) fluorinating a Group IVb transition metal-bearing ore, which comprises Group IVb transition metal oxides, by contacting with an alkali metal fluosilicate at a temperature of from about 600° to about 1000° C. to form a fluorinated ore and to convert said Group IVb transition metal oxides to Group IVb transition metal fluorides;

(b) reducing said Group IVb transition metal fluorides with a zinc alloy to produce said Group IVb transition metal-zinc alloy which is substantially free of halides;

(c) forming said Group IVb transition metal-zinc alloy, which is substantially free of halides, into particles having a particle size distribution of about 90% by weight between about 80 mesh and about ¼ inch;

(d) heating said particles in a zone maintained at a temperature between about 500° and about 1150° C., and simultaneously introducing into said zone a continuous flow of a nondeleteriously-reactive sweep gas, said zone being maintained under conditions operative to vaporize and separate zinc from said transition metal-zinc alloy particles and to produce first particles of Group IVb transition metal values which are substantially free of zinc and halides;

(e) heating said first particles to, or, maintaining said first particles at, a sintering temperature between about 850° and 1150° C. under conditions operative to sinter said first particles;

(f) cooling said sintered first particles to a lower temperature between about ambient temperature and about 200° C.;

(g) contacting said cooled sintered first particles with a small amount of a gas selected from the group consisting of oxygen, nitrogen, and mixtures thereof under conditions operative to passify said cooled sintered first particles, thereby producing Group IVb passified transition metal-based, metal particles which are substantially free of halides; and (h) said forming a transition metal-zinc alloy of a specified particle size distribution in step (c), and said heating of said first particles in step (d) being operative to cause said passified transition metal-based, metal particles produced in step (g) to have a particle size distribution such that a significant amount by weight of said passified transition metal-based metal particles are suitable for powder metallurgy usage without additional particle size reduction; and wherein the entire process is conducted at temperatures which are no higher than about 1150° C.

25. The process of claim 15 wherein said Group IVb transition metal-zinc alloy particles formed in step (a) has a particle size distribution of about 90% by weight between about 60 mesh and about 20 mesh.

26. The process of claim 15 wherein said forming of a Group IVb transition metal-zinc alloy into particles in step (a) comprises comminuting of said alloy.

27. The process of claim 15 wherein said forming of a Group IVb transition metal-zinc alloy into particles in step (a) comprises casting said alloy.

28. A process to produce passified Group IVb transition metal-based metal particles which are substantially free of halides, and which are suitable for powder metallurgy usage, from a Group IVb transition metal-zinc alloy comprising:

(a) forming a Group IVb transition metal-zinc alloy, which is substantially free of halides, into particles having a particle size distribution of about 90% by weight between about 80 mesh and about ¼ inch;

(b) heating said particles in a zone maintained at a temperature between about 500° and about 1150° C., and simultaneously introducing into said zone a continuous flow of a nondeleteriously-reactive sweep gas, said zone being maintained under conditions operative to vaporize and separate zinc from said transition metal-zinc alloy particles and to produce first particles of Group IVb transition metal values which are substantially free of zinc and halides;

(c) heating said first particles to, or maintaining said first particles at, a sintering temperature between about 850° and 1150° C. under conditions operative to sinter said first particles;

(d) cooling said sintered first particles to a lower temperature between about 300° and about 700° C, and simultaneously contacting said first particles with hydrogen under conditions operative to hydride and embrittle said first particles, thereby forming embrittled transition metal values;

(e) comminuting said embrittled transition metal values under a nondeleteriously-reactive atmosphere, to a predetermined particle size distribution thereby forming particles of transition metal values;

(f) dehydriding said particles of transition metal values at a temperature between about 400° and 700° C. under conditions operative to remove essentially all hydrogen values from said particles of transition metal values and to produce dehydrided particles of transition metal values; and (g) contacting said dehydrided particles with a small amount of a gas selected from the group consisting of oxygen, nitrogen, and mixtures thereof under conditions operative to passify said dehydrided particles thereby producing passified Group IVb transition metal based metal particles which are substantially free of halides; and (h) said forming of a transition metal-zinc alloy of a specified particles size distribution in step (a), said heating of said first particles in step (c), and said comminuting of said embrittled transition metal values to predetermined particle size distribution in step (e) being operative to cause said passified transition metal-based metal particles produced in step (g) to have a particle size distribution such that at least a substantial amount by weight of said passified transition metal-based metal particles are suitable for powder metallurgy usage with further particle size reduction.

* * * * *

UNITED STATES PATENT AND TRADEMARK OFFICE

CERTIFICATE OF CORRECTION

PATENT NO. : 4,470,847

DATED : September 11, 1984

INVENTOR(S) : Robert A. Hard et al

It is certified that error appears in the above-identified patent and that said Letters Patent is hereby corrected as shown below:

In the drawings, Sheet 2 of 2, change "BRAKING" to --BREAKING--. Column 1, line 10, change "Ore" to --Ore."--; Column 1, line 25, change "braising" to --brazing--; Column 1, line 35, change "Ivb" to --IVB--; Column 1, lines 56,57, delete "By particles as used herein, is" and insert --Particles, as used herein, are--; Column 1, line 64, change "metal" to --metals--; Column 2, line 14, delete the ","; Column 3, line 27, change "other" to --another--; Column 3, line 33, delete "where"; Column 4, line 60, change "psuedomorph" to --pseudomorph--; Column 5, line 55, change "Process"," to --Process,"--; Column 6, line 1, delete "of"; Column 6, line 18, change "process" to --processes--; Column 6, line 29, change "8000" to --800--; Column 7, lines 27,29, change "soluable" to --soluble--; Column 7, line 31, change "crysalize" to --crystallize--; Column 7, lines 65,66 change "dipicted" to --depicted; Column 8, line 40, change "through" to --though--; Column 8, line 43, change "annd" to --and--; Column 8, line 44, change "whereby" to --wherein--; Column 8, line 67, change "discription" to --description--;

UNITED STATES PATENT AND TRADEMARK OFFICE

CERTIFICATE OF CORRECTION

PATENT NO. : 4,470,847

DATED : September 11, 1984

INVENTOR(S) : Robert A. Hard et al

It is certified that error appears in the above-identified patent and that said Letters Patent is hereby corrected as shown below:

Column 9, line 8, change "construded" to --construed--; Column 9, line 49, change "dehydrated" to --dehydrided--; Column 11, line 32, change "power" to --powder--; Column 12, line 32, change "clam" to --claim--; Column 14, line 36, change "particles" to --particle--.

Signed and Sealed this

*Eighth* Day of *October 1985*

[SEAL]

*Attest:*

DONALD J. QUIGG

*Attesting Officer*

*Commissioner of Patents and Trademarks—Designate*